United States Patent [19]

Ehmann et al.

[11] 4,281,531

[45] Aug. 4, 1981

[54] BLIND RIVETER WITH PNEUMATIC RIVET-CORE DISPOSAL

[75] Inventors: Hans Ehmann, Frankfurt am Main; Walter Bieber, Dreieich; Hans Baier, Gross-Gerau, all of Fed. Rep. of Germany

[73] Assignee: Gesipa Blindniettechnik GmbH, Frankfurt am Main, Fed. Rep. of Germany

[21] Appl. No.: 50,960

[22] Filed: Jun. 22, 1979

[30] Foreign Application Priority Data

Jun. 24, 1978 [DE] Fed. Rep. of Germany ..... 2827904
Jun. 24, 1978 [DE] Fed. Rep. of Germany ..... 7819059

[51] Int. Cl.[3] ..... B21J 15/34
[52] U.S. Cl. ..... 72/391; 72/453.17
[58] Field of Search ..... 72/391, 453.17; 29/243.53, 243.54

[56] References Cited

U.S. PATENT DOCUMENTS

| | | | |
|---|---|---|---|
| 3,082,898 | 3/1963 | Bosch | 72/453.17 |
| 3,415,102 | 12/1968 | Elliott | 72/391 |
| 3,457,763 | 7/1969 | Freeman | 72/391 |
| 3,523,441 | 8/1970 | Bell | 72/453.17 |
| 3,630,067 | 12/1971 | Henshaw | 72/391 |
| 4,062,217 | 12/1977 | Ebbert | 72/453.17 |
| 4,088,003 | 5/1978 | Schwab | 72/453.17 |

*Primary Examiner*—Lowell A. Larson
*Assistant Examiner*—Gene P. Crosby
*Attorney, Agent, or Firm*—Montague & Ross

[57] ABSTRACT

A blind riveter has a T-shaped housing whose one T-arm forms a working tip provided with a reciprocal internal chuck, whose other arm is formed as a hollow compartment, and whose central T-leg incorporates a pneumatic cylinder. The cylinder can displace the chuck to pull the mandrel of a blind rivet, thereby pulling the rivet back against the tip to upset the rivet. A passage extends from the chuck back into the compartment. The cover of the compartment is formed with a jet pump that is powered off the pneumatic supply that operates the riveter and serves to suck a mandrel pulled from a rivet back from the chuck into the compartment.

14 Claims, 5 Drawing Figures

FIG. 2A
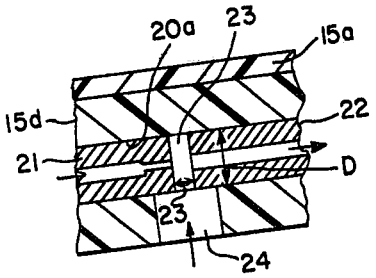
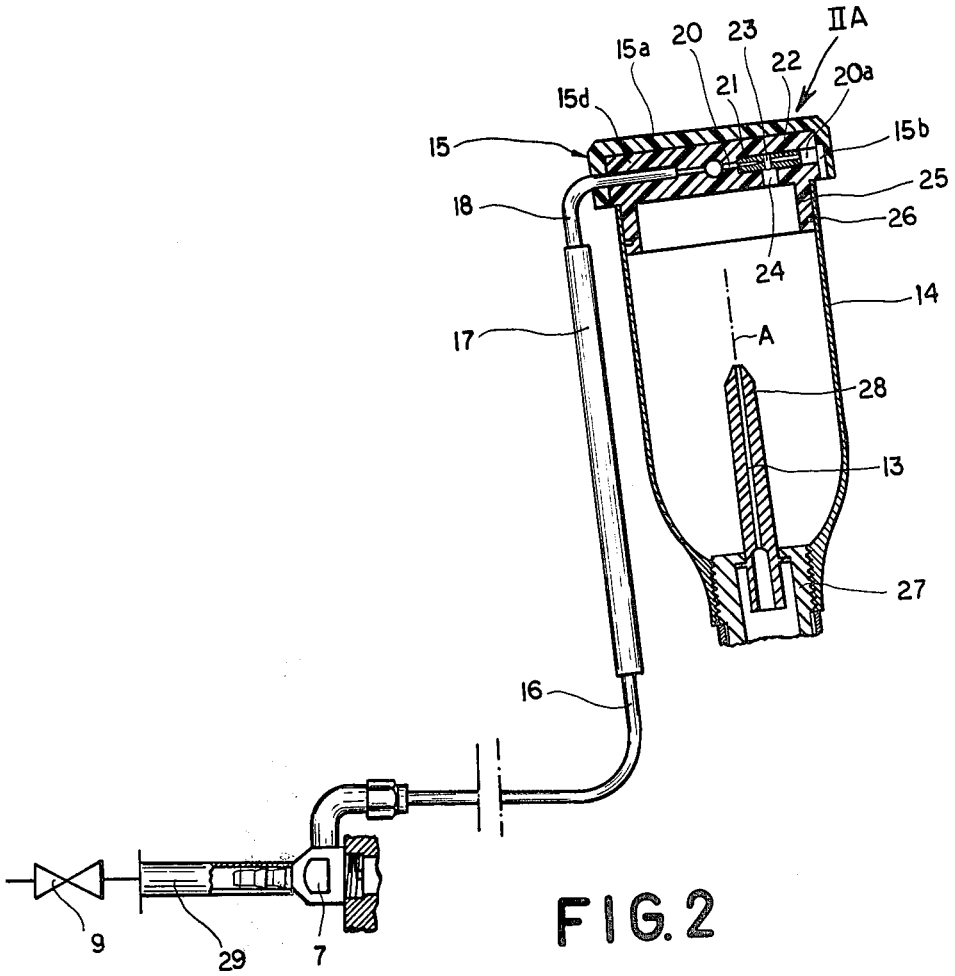
FIG. 2

BLIND RIVETER WITH PNEUMATIC RIVET-CORE DISPOSAL

FIELD OF THE INVENTION

The present invention relates to a blind riveter. More particularly this invention concerns a rivet-core aspirating system for a blind riveter.

BACKGROUND OF THE INVENTON

A blind rivet has an outer normally tubular body formed at one end with a head and provided internally with a rivet core or mandrel. The mandrel is gripped by a chuck of the riveting tool which is then operated to pull this chuck away from a fixed tip to pull the head of the rivet against this tip, and then to pull the mandrel though the rivet to upset the far end of it. The mandrel is normally constructed to break when tensioned to a predetermined limit corresponding to a predetermined deformation or upsetting of the rivet and depending on the rivet material.

For production use such blind riveters are normally operated pneumatically, hydraulically, or with combined air and hydraulic systems. The details of the operation of such riveters can be seen in U.S. Pat. Nos. 4,005,598; 4,027,520; and 4,050,285.

It is known to form the back of the head of such a riveting tool with a compartment for receiving the mandrels after they have been pulled from the respective rivets. In the simplest system a throughgoing passage extends from the chuck back into this empty compartment, so that as new mandrels are inserted in the chuck the old ones are pushed upwardly. Normally the operator of the tool turns the device over and bumps it on the top of the storage compartment to move the old mandrel out of the chuck and into this compartment. Such an arrangement, although somewhat tedious to operate, nonetheless eliminates the necessity of cleaning up all the mandrels after a large riveting job.

Accordingly it has been suggested to provide a pneumatic conveying system inside the riveter which is connected to a passage immediately at the head or tip of the riveter so that a current of air blows the mandrel back into the storage compartment at the end of the riveting operation. Such a system requires a complicated connection to the tip or working head of the riveter, and normally requires the pulling chuck to be at least partially rebuilt to accommodate the new pneumatic system. Another disadvantage is that the air blown into the passage through the chuck moves in both directions, resisting insertion of a new mandrel just as it aids in moving the old mandrel along to the storage compartment. Thus a new rivet must be carefully inserted into the tool which must then be briefly actuated to tightly grip the new rivet before the worker can release it with his or her fingers.

OBJECTS OF THE INVENTION

It is therefore an object of the present invention to provide an improved blind riveter.

Another object of this invention is to provide an improved system for conveying away and storing the mandrels once they have been pulled from their rivets.

A further object is to provide such a system which can easily be retrofitted on a riveter of the above-described general type without expensive and substantial reconstruction of it.

SUMMARY OF THE INVENTION

These objects are attained according to the instant invention in a blind riveter of the above-described type, that is having a housing provided with a tip and forming a passage open at one end at the tip and having another end open in a substantially closed mandrel compartment on the housing. A chuck is displaceable in the housing adjacent the tip as described above so that a rivet mandrel can be engaged in the chuck with the respective rivet body bearing against the tip so that displacement of the chuck pulls the mandrel through the rivet body to upset it. In accordance with this invention means is provided for aspirating air from the mandrel-storage compartment and thereby for forming an air current through the passage to the chuck so as to suck a mandrel pulled from the respective rivet body into the compartment. In this manner suction is exerted at the storage compartment, eliminating a complicated connection of the pneumatic line to the working tip of the riveter. In addition a constant suction is exerted at the tip, so that not only is the old mandrel sucked along the passage, but when a new mandrel is inserted therein suction is applied to it also. In fact this suction is normally great enough to hold a rivet in place on the tip, so that the user of the riveter according to this invention need not actuate the trigger of the tool slightly to grip the mandrel of the new rivet. For this reason the system according to this invention eliminates the extra steps occasionally necessitated for disposing of a mandrel, and in addition eliminates other steps in the riveting operation that were normally taken for granted.

According to further features of this invention the compartment is provided with a removable cover incorporating a jet pump having a high-pressure input connected to the source of compressed air that powers the riveter, a low-pressure intake connected to and opening into the compartment, and an output open to the outside. Thus the high-pressure compressed air used to operate the riveter passes through this jet pump so as to depressurize the storage compartment and create the pressure differential necessary to suck the mandrel back through the passage into this compartment once its rivet body has been separated from it.

According to further features of this invention the cap is formed with a plurality of radial bores all communicating with each other. One of them is constituted as an output bore and is connected via an at least partially flexible conduit to a special tee provided at the inlet nipple on the rear end of the tool. The others are each provided with a pair of nozzles flanking respective holes opening into the compartment and forming the above-mentioned low-pressure intakes. The upstream nozzle of each pair has a relatively small aperture to create the desired jet-pump effect. Normally the two nozzles are spaced apart by a distance equal at most to one-tenth the diameter of the respective bore.

It is therefore possible to retrofit a blind riveter having a storage compartment with the pneumatic aspiration device according to this invention. To this end a tee fitting is inserted at the rear end of the housing of the riveter and a new cap is provided for the storage compartment. The partially flexible conduit connecting the tee fitting and the new cap in no way interferes with the operation of the riveter.

It is possible according to this invention to provide a flow-reducing valve on the tee fitting so that the amount of suction exerted in the storage compartment, which is generally proportional to the amount of air admitted to the high-pressure inputs of the jet pumps, can be varied. Furthermore such a flow-reducing valve can be shut completely, if desired, to eliminate the automatic mandrel aspiration.

BRIEF DESCRIPTION OF THE DRAWING

FIG. 2 is a partly sectional and partly diagrammatic view of the system according to this invention.

FIG. 2A is a large-scale view of the detail indicated at IIA in FIG. 2;

SPECIFIC DESCRIPTION

Figure 1:
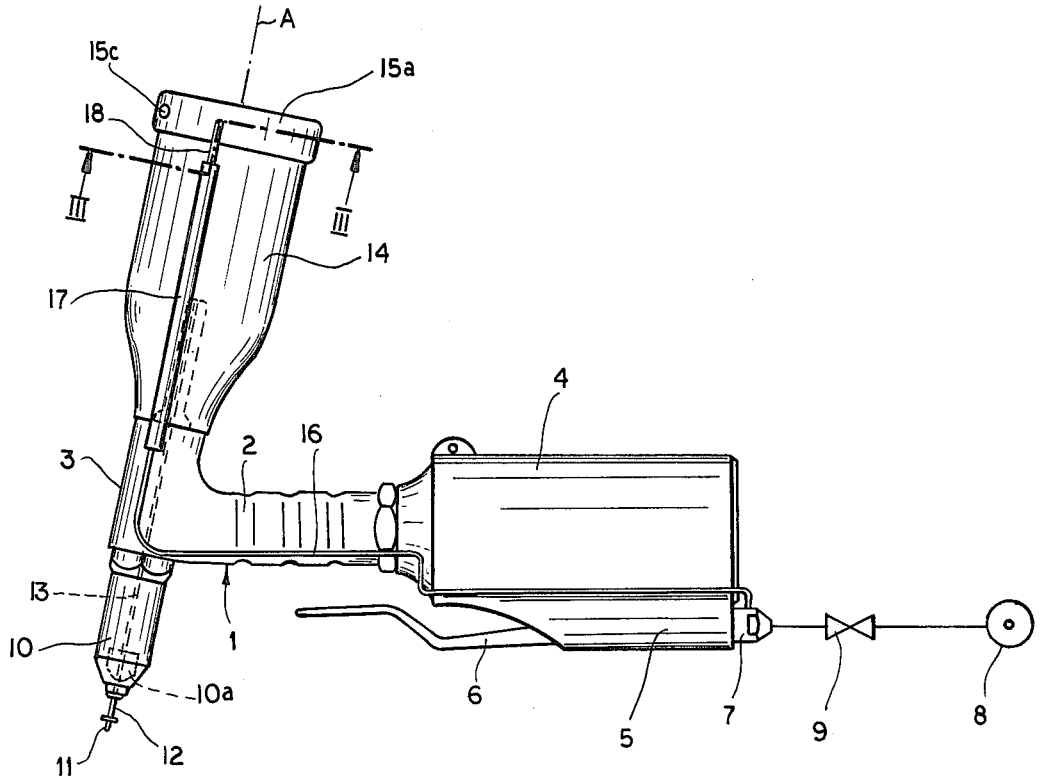
FIG. 1 is a side partly schematic view of a riveter according to this invention.

As shown in FIG. 1 a riveter of the air-hydraulic type as described in the above-cited U.S. Pat. No. 4,050,285 has a T-shaped housing 1 having a neck 2 constituting a hand grip and connected at a head 3 to a working tip or nose 10 on one side and a storage compartment 14 on the other. The tip 10 is provided with a chuck 10*a* displaceable along an axis A by mechanism operated by a pneumatic cylinder 4 constituting the central leg of the T-shaped housing 1. This cylinder 4 is pressurized via a valve 5 operated by means of a handle or trigger 6 and supplied with compressed air via an inlet nipple or tee 7. A source 8 of compressed air is connected via a valve 9 to this inlet nipple 7.

The tool is used to set a blind rivet 11 having a mandrel 12 that is fitted into an axially extending passage 13 that passes through the chuck 10*a*. Axial backward displacement of this chuck 10*a* while gripping the mandrel 12 will pull the rivet 11 against the tip 10 and then pull the mandrel 12 through the rivet 11 to upset it.

Figure 3:
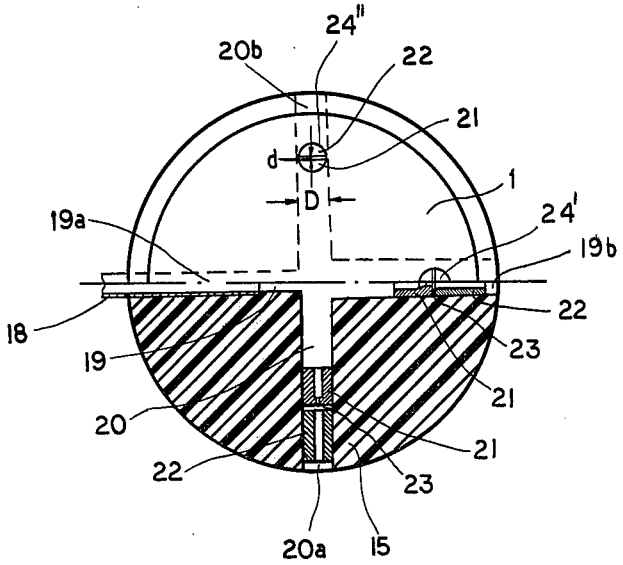
FIG. 3 is a cross section taken along line III—III of FIG. 1.

As also shown in FIGS. 2 and 3 the compartment 14 is centered on the axis A of the passage 13 and is screwed onto a portion 27 of the housing 1. An extension 28 of the housing centered on the axis A opens in the approximate center of the compartment 14. In addition this compartment 14 has a removable cover 15 formed of a cup-shaped cap 15*a* and a disk 15*d*. The disk is formed as shown in FIG. 3 with perpendicular diametral bores 19 and 20. The bore 19 has a section 19*a* receiving a rigid ell 18 connected via a flexible synthetic-resin tube 17 to another ell 16 connected to the inlet nipple 7. The other portion 19*b* of the bore 19 as well as both portions 20*a* and 20*b* of the bore 20 are of like diameter D and are provided as also shown in FIG. 2A with small-orifice nozzles 21 and large-orifice nozzles 22 separated by respective gaps 23. The gaps 23 are spaced apart by a distance d equal to approximately one-tenth of the diameter D. The orifice size of the upstream nozzles 21 is substantially smaller than that of the downstream nozzles 22 to create a jet-pump effect. In addition the downstream nozzles 22 can be screwed into the respective bore sections 20*a*, 20*b*, and 19*b* to vary the size of the respective gap 23 and, hence the jet-pump effect. The disk 15*d* is formed underneath each of these gaps 23 with a downwardly open bore 24, 24' and 24''. In addition the disk 15*d* is formed with a downwardly extending rim 25 provided with an O-ring 26 for forming a snug airtight fit with the compartment wall 14. What is more the cap 15*a* is formed with a downwardly extending rim forming a downwardly open recess 15*b* at which the outer ends of the sections 20*a*, 20*b*, and 19*b* open. The rim of the cap 15*a* may also be formed as shown in FIG. 1 with radially outwardly open holes 15*c*.

With the system according to the instant invention, therefore, the compressed air from the conduit formed by the elements 16, 17, and 18 will be forced from the small-orifice nozzles 21 to pass through the large-orifice nozzles 22, thereby creating a jet-pump effect and aspirating air from the interior of the compartment 14 via the holes 24. This low pressure will serve to aspirate mandrels 12 through the passage 13 into the compartment 14. The spent air will issue from the recess 15*b* downwardly along the side of the compartment 14 so as not to interfere with the operator at all. In addition the suction at the tip 10 will serve to hold a new rivet 11 tightly in place. In the event that a mandrel becomes slightly jammed in the chuck 10*a* insertion of a new mandrel 12 will free it enough so the suction will be able to displace it upwardly in the tube 13, while the new mandrel 12 will be sucked along this passage 13 to hold the respective rivet 11 in place on the tip 10. When the compartment 14 is full the operator merely pulls off the cap 15 and empties it, such disassembly being possible due to the flexibility of the tubing section 17.

Figure 4:
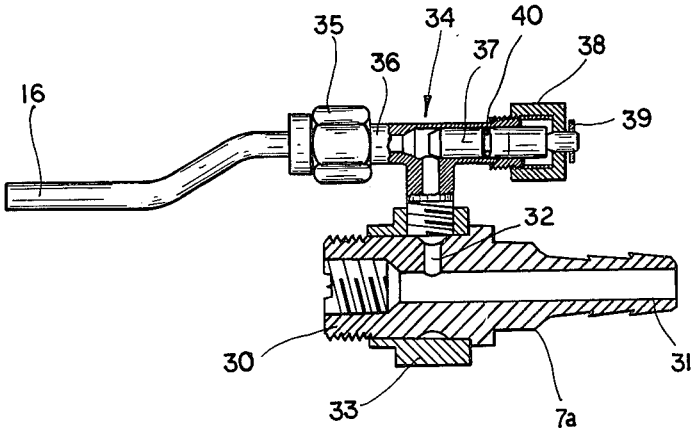
FIG. 4 is a large-scale sectional view of a detail of the instant invention.

FIG. 4 shows a fitting 7*a* that can replace the fitting 7 of FIGS. 1 and 2. This fitting 7*a* is basically formed as a tee having on side 30 adapted to be screwed to the rear end of the leg of the T-shaped housing 1, a ridged inlet side adapted to be connected to a flexible hose 29 from the compressor 8, and a lateral 32 opening at a ring 33 provided with another T-fitting 34 constituted as a valve. A nut 35 connects the rigid part 16 of the conduit to one side 36 of this fitting 34. A valve body 37 having a cap 38 held in place by a disk 39 and having an O-ring 40 is displaceable to vary flow through this fitting 34. Thus the user can increase or decrease the suction effect by operation of the knob 38. The automatic mandrel aspiration can be completely shut off with this valve 34 if desired.

It is possible to retrofit an existing riveter with the system according to this invention merely by mounting a new cap on the compartment 14 and providing a new inlet nipple 7. It is also a relatively easy task to mount the extension 28 and entire compartment 14 on many existing models of blind riverters.

We claim:

1. A blind riveter for setting blind rivets having rivet bodies each having a pull-out mandrel, said riveter comprising:

a housing having a tip and forming a passage opening at one end at said tip and having another end;

a chuck displaceable in said housing adjacent said tip, whereby a rivet mandrel can be engaged in said chuck with the respective rivet body bearing against said tip so that displacement of said chuck pulls the mandrel through the rivet body to upset same;

a source of compressed gas;

pneumatically operable drive means connected between said source and said chuck to displace same in said housing;

a substantially closed compartment on said housing at the other end of said passage; and means including a pump having a high-pressure input connected to said source and a low-pressure intake connected to said compartment for aspirating air from said compartment and thereby for forming an air current through said passage to such a mandrel pulled from the respective rivet body into said compartment.

2. The riveter defined in claim 1 wherein said housing is generally T-shaped, having one T-arm forming said tip, another T-arm forming said compartment, and a central T-leg including said drive means and adapted to be held in the hand.

3. The riveter defined in claim 2 wherein said compartment has a removable cover provided with said pump comprising said means for aspirating.

4. The riveter defined in claim 2 wherein said housing is formed with an extension projecting into said compartment and formed internally with said passage.

5. A blind riveter for setting blind rivets having rivet bodies each having a pull-out mandrel, said riveter comprising:

a housing having a tip and forming a passage opening at one end at said tip and having another end;

a chuck displaceable in said housing adjacent said tip, whereby a rivet mandrel can be engaged in said chuck with the respective rivet body bearing against said tip so that displacement of said chuck pulls the mandrel through the rivet body to upset same;

a source of compressed gas;

pneumatically operable drive means connected between said source and said chuck to displace same in said housing;

a substantially closed compartment on said housing at said other end of said passage; and means including a jet pump having a high-pressure input connected to said source, a low-pressure intake connected to said compartment, and an output open to the outside for aspirating air from said compartment and thereby for forming an air current through said passage to suck a mandrel from the respective rivet body into said compartment.

6. The riveter defined in claim 5 wherein said compartment has a removable cover incorporating said jet pump, said drive means having an input nipple on said housing, said means for aspirating including an at least paritally flexible inlet conduit extending between said input nipple and said high-pressure input of said cover.

7. The riveter defined in claim 6 wherein said cover is provided with a formation releasably securing it to said compartment.

8. The riveter defined in claim 6 wherein said inlet nipple is a tee having a lateral connected to said conduit.

9. The riveter defined in claim 8 wherein said inlet is formed with a flow-reducing valve connected to said lateral for varying flow into said conduit.

10. The riveter defined in claim 8 wherein said conduit is partially made of a flexible synthetic-resin tube.

11. The riveter defined in claim 5 wherein said jet pump includes an upstream nozzle of predetermined relatively small cross section at said output, said low-pressure intake opening between said nozzles.

12. The riveter defined in claim 11 wherein said cover is formed with a bore having a bore diameter and receiving said nozzles, said nozzles being spaced apart in said bore by a distance equal generally to one-tenth said diameter.

13. The riveter defined in claim 12 wherein said cover is formed with a plurality of such bores each in turn provided with one such jet pump.

14. The riveter defined in claim 13 wherein said cover is formed with an overreaching rim spaced from and extending across said bores, whereby air issuing from said bores is deflected by said rim.

* * * * *